US005816686A

United States Patent [19]

Wang et al.

[11] Patent Number: 5,816,686

[45] Date of Patent: Oct. 6, 1998

[54] ELECTRIC LAMP ASSEMBLY WITH REFLECTOR HAVING INTERLOCKING CONNECTION JOINT

[75] Inventors: Jessica Wang; Dennis Wang, both of Taipei, Taiwan

[73] Assignee: Toyo Electric Manufacturing Co. Ltd., Taipei, Taiwan

[21] Appl. No.: 627,599

[22] Filed: Apr. 14, 1996

[51] Int. Cl.[6] ..... F21V 17/04

[52] U.S. Cl. ..... 362/226; 362/296; 362/448; 362/806

[58] Field of Search ..... 362/122, 226, 362/249, 250, 806, 457, 297, 296, 448, 437, 433

[56] References Cited

U.S. PATENT DOCUMENTS 4,219,870 8/1980 Haraden et al. ..... 362/226

5,394,315 2/1995 Ahroni ..... 362/226

*Primary Examiner*—Alan Cariaso

*Attorney, Agent, or Firm*—Martin Smolowitz

[57] ABSTRACT

A miniature electric lamp and reflector assembly including a bulb holder unit with an electric memory retaining bulb and a base socket member for receiving the insert plug. The base socket has a member shaped cavity to accept the plug and a reflector member lower end, and has dual oppositely located radial projections at its upper end; a reflector has an annular-shaped lower sleeve portion which contains dual oppositely-located longitudinal grooves and is provided with an annular stop surface and dual notches at its upper end. Insertion of the base socket member upper end into the reflector member sleeve permits the dual projections to slide through the dual longitudinal grooves, and be rotated into the notches, which results in an interlocking connection joint between the base socket member the reflector.

8 Claims, 2 Drawing Sheets

FIG.5
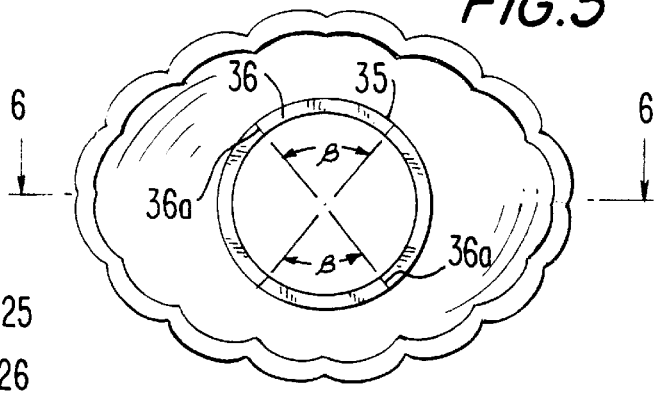
FIG.3
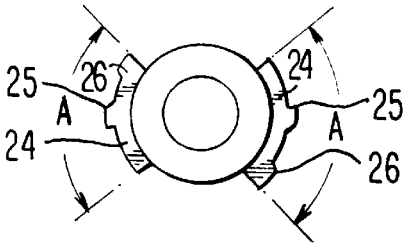
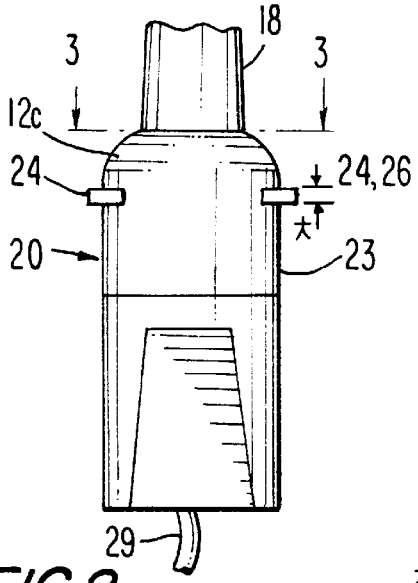
FIG.2
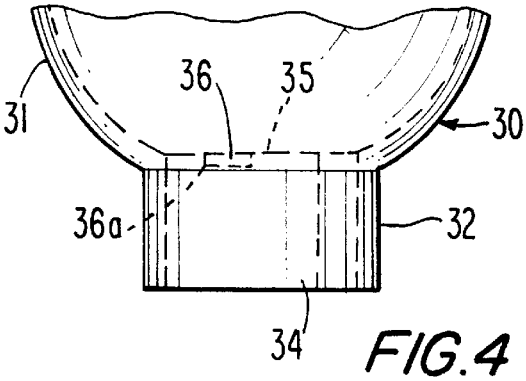
FIG.4
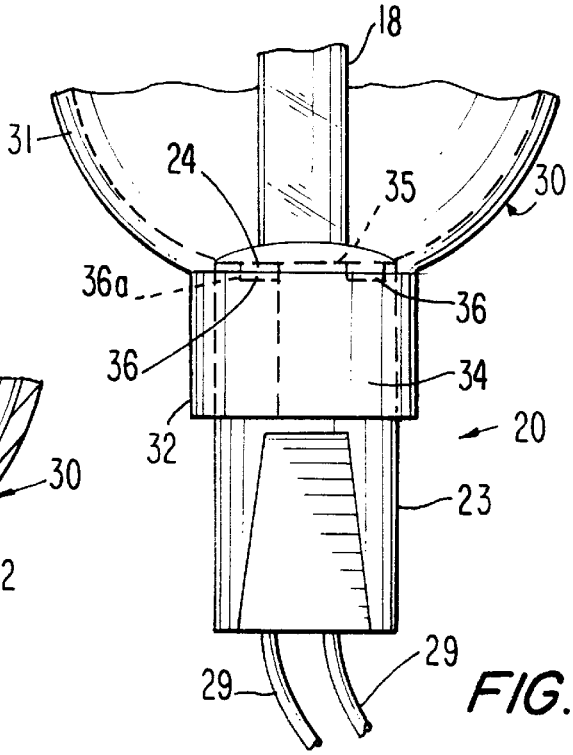
FIG.7
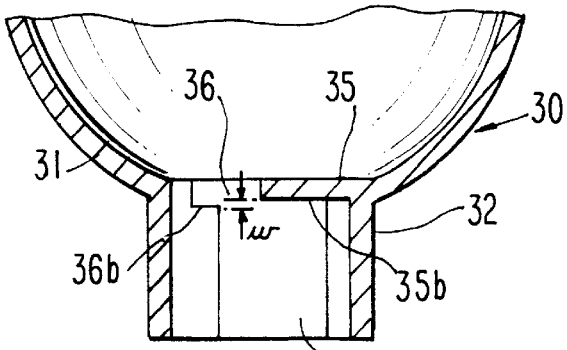
FIG.6

ELECTRIC LAMP ASSEMBLY WITH REFLECTOR HAVING INTERLOCKING CONNECTION JOINT

BACKGROUND OF INVENTION

This invention pertains to miniature electric lamp assemblies such as used in decorative light sets. It pertains particularly to such lamp assembly including an electric bulb holder unit and a base member socket both inserted into a detachable reflector and connected firmly together by an interlocking joint configuration.

Conventional miniature lamp assemblies such as used in Christmas tree light set or strings strings usually include a base socket having two electrical outer insulated wires extending from its lower end and a cavity into which a bulb holder unit having two exposed wires is inserted, so as to connect with the outer insulated wires. The base socket is usually inserted into a decorative reflector unit. Typical examples of such lamp assemblies are disclosed by U.S. Pat. No. 4,679,126 to Van Sickler, U.S. Pat. No. 5,012,397 to Tseng, U.S. Pat. No. 5,394,315 to Ahroni, and U.S. Pat. No. 5,435,741 to Wang. Other similar lamp assemblies are disclosed by U.S. Pat. No. 4,477,864 to Van Duyn et al and U.S. Pat. No. 5,010,455 to Lauling et al.

The lamp assemblies of such light strings are often connected together in series, so that the disconnection of any single bulb from its base socket breaks the electrical circuit for the entire light string. Sometimes a bulb plug-in portion of the lamp base socket works loose from the base socket sufficiently to break electrical contact between the bulb wires and the contact elements in the base socket. Also, the lamp reflector sometimes becomes loosened from the lamp holder socket, such as may occur during packing, shipping or handling while being mounted in a decorative location or position. Accordingly, a need exists for an effective and practical locking configuration not only to prevent unintentional disconnection of a lamp holder plug-in portion from the lamp base socket, but also to prevent dislodgement of the lamp base socket and its reflector. This invention provides a lamp assembly having an insertion-type interlocking connection joint configuration adapted for connecting together an elongated male member, such as a holder for a small electrical bulb base socket with a cylindrical-shaped female member such as an annular sleeve of a decorative reflector for the bulb.

SUMMARY OF INVENTION

The present invention provides a miniature electric lamp and reflector assembly useful in decorative light sets or strings, and, including a bulb holder unit with an insert plug member having a bulb and with dual bare wires extending from its lower end, and a base socket member having a cavity adapted to receive the insert plug member lower end portion. The base socket member has dual oppositely-located radial projections provided near its upper end and two electrically insulated wires extending from its lower end.

A reflector member has an annular-shaped lower sleeve portion which contains dual radial oppositely-located longitudinal grooves each of which has a stop surface and has dual notches provided at its upper end. When the base upper end is inserted into the reflector together with the bulb holder lower unit sleeve portion, the dual radial projections slide through the dual longitudinal grooves and are rotated into the dual notches, so as to provide an interlocking connection joint between the base socket and reflector members.

BRIEF DESCRIPTION OF DRAWINGS

This invention will be further described by references to the following drawings, in which:

FIG. 2 shows an elevational view of the bulb holder plug member inserted into base socket member according to the present invention, FIG. 3 shows a plan view taken at line 3—3 of FIG. 2;

FIG. 4 shows an elevational view of a reflector unit adapted to be interlocked with the base socket member;

FIG. 5 shows a plan view of the reflector unit of FIG. 4;

FIG. 6 shows a sectional elevation view taken at line 6—6 of FIG. 5; and FIG. 7 shows an assembled view of the miniature lamp assembly of the present invention.

DESCRIPTION OF INVENTION

Figure 1:
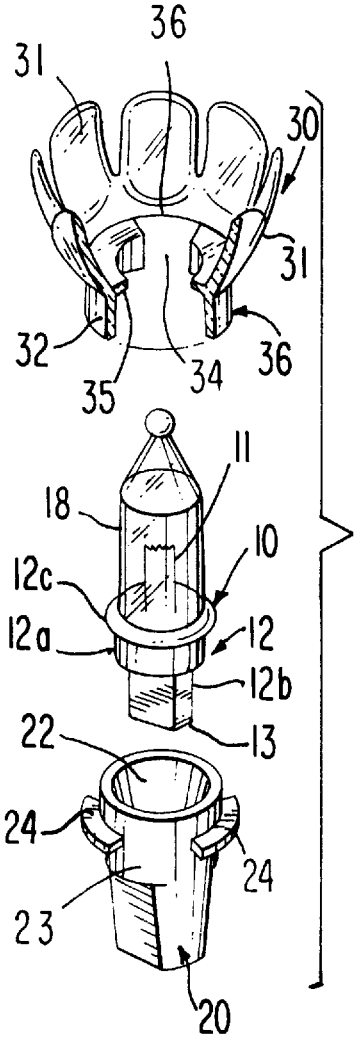
FIG. 1 is an exploded perspective view of a miniature lamp assembly bulb holder plug member holder including a bulb a and socket member which is received and interlocked in a reflector member according to the present invention.

As generally shown by FIG. 1, an electric bulb holder unit 10 including a bulb 18 having internal lighting element 11 is provided attached into a plug insert member 12 which has two bare wires 13 extending from its lower end; which wires are each electrically connected internally to the lighting element 11 within the electric bulb 18. The insert plug member 12 includes an upper cylindrical portion 12*a* a lower portion 12*b* having a generally rectangular shape; and and an annular outer rim portion 12*c* plurality of longitudinal radial projections 14 are provided on the outer surface of the upper cylindrical portion 12*a* of the insert plug member 12.

The lower portion of insert plug member 12 is adapted to fit snugly into a base socket member 20, so that the multiple elongated radial projections 14 extending radially outwardly from the outer surface of upper cylindrical portion 12*a* provide a snug force fit into a complementary-shaped cavity 22 provided in the base socket member 20.

As shown by FIGS. 2 and 3, the base socket member 20 includes an elongated cylindrical portion 23 having two narrow arcuate-shaped projections 24 extending radially outwardly from the cylindrical portion 23 near its upper end. The radial projections 24 are located diametrically opposite each other and each extend circumferentially for an angle A of 60°–80° along the surface 23 radial. Each arcuate-shaped projection 24 includes an intermediate portion 25 which extends slightly outwardly from the projection 24 outer surface, and also has a stop surface 26 provided at one end of each projection 24. The plug member 12 including electrical bulb 18 is inserted and retained into the upper end of the socket cylindrical portion 23, and the dual exposed wires 13 extend outwardly from and are in electrical contact with dual insulated wires 29 extending from the lower end of the base socket member 20 lower end.

The base socket member 20 is adapted to be inserted together with the plug member 12 into a hollow sleeve portion of reflector 30, which includes a lower cylindrical-shaped sleeve portion 32 and an upper concaved-shape decorative portion 31 each having inner and outer walls, as generally shown by FIGS. 4 and 5. The reflector lower cylindrical-shaped portion 32 includes two inner elongated longitudinal grooves 34 located and shaped so as to receive the dual radial projections 24 of the base member 20. The grooves 34 each have an arcuate angle B which is at least equal to angle A of the dual projections 24.

Also provided in reflector 30 at the upper end of each elongated groove 34, is an annular stop element 35 and an adjacent dual notches 36. The dual grooves 34 and notches 36 in combination with the stop surface 35 provide for the base socket member 20 to be inserted into the reflector cylindrical-shaped portion 32 until the dual radial projections 24 each contact the respective annular stop element 35, after which the base socket member 20 is rotated in a clockwise direction so that the dual projections 24 are each received in one of the notches 36 of the reflector 30. Lower surface 35*b* of stop element 35 is located above notch surface 36*b* by a notch upper surface with the distance slightly exceeding the thickness dimension the of dual projections 24. The clockwise rotation of base socket member 20 within the cylindrical of the reflector 30 portion 32 is halted by each stop surface 26 of radial projections 24 contacting end 36*a* of each notch 36. The reflector member 30 upper portion 40, can have any desired decorated shape, such as simulated petals of a flower, and can be molded from a clear rigid plastic material. Electric power is provided to the bulb 18 through the two insulated wires 29 located at the lower end of the base socket 20.

An assembly of the base socket member 20 upper portion into the lower end portion of the reflector member 30 is generally shown by FIG. 7. It is seen that the dual radial projections 24 each slide upwardly through the longitudinal grooves reflector 34 in cylindrical portion 32 until they are stopped by the annular stop element 35. The dual radial projections 24 included angle A is about two times the angular length of each second notch 36. The cylindrical portion 23 of base socket member 20 is then rotated clockwise by an angle of about A/2, which permits the dual radial projections 24 to be turned clockwise past a friction point provided by intermediate projection 25 and received into the dual second notches 36, thereby locking the socket member 20 together with unit bulb firmly into the reflector member 30.

We claim:

1. A decorative miniature electric lamp and reflector assembly, comprising:

(a) a bulb holder unit including an electric bulb having dual bare wires provided within an insert plug member, said insert plug member having a cylindrical shaped upper portion and a lower portion having a lower end and with the dual bare wires extending from the insert plug member lower end;

(b) a base socket member having a cylindrical-shaped upper portion and lower portion, and having a cylindrical-shaped cavity provided in the base socket member upper portion, said cavity being complementary in shape so as to receive the insert plug member lower portion, and provide a snug fit therebetween, said base socket member having an upper end and having dual oppositely-located radial projections provided near the base socket member upper end; said base socket member having a lower end and having dual electrical insulated wires which connect internally with said dual bare wires and extend from the base socket member lower end, and (c) a reflector member having a cylindrical-shaped lower sleeve portion with the sleeve portion containing dual inner oppositely-located longitudinal extending grooves, with each said inner longitudinal groove having an upper end and having a stop surface and adjacent notch provided at each said longitudinal groove upper end, said dual inner grooves and notches each being shaped to receive one of the radial projections of said base socket member, whereby the base socket member upper portion can be inserted into the reflector member lower cylindrical-shaped sleeve portion and then rotated so as to engage the socket member dual radial projections snugly in the reflector member dual notches and thereby provide an interlocking connection joint between the base socket member and the reflector member.

2. The lamp and reflector assembly of claim 1, wherein said insert plug member cylindrical shaped upper portion has an outer surface with multiple radial projections extending longitudinally along the outer surface, so as to provide the snug fit within the base socket member cylindrical-shaped cavity and said insert plug member lower portion which has a rectangular shape.

3. The lamp and reflector assembly of claim 1, wherein the dual oppositely-located radial projections of said base socket member each extend circumferentially through an angle A of 60°–80° and has an intermediate fictional element (25) provided on each said radial projection outer surface.

4. The lamp and reflector assembly of claim 1, wherein said reflector member lower sleeve portion dual longitudinal grooves each has an annular shaped stop surface provided at each said groove upper end, and each said groove has a horizontal notch located below each said stop surface and into which notch the dual radial projections of the socket member interfit after the base socket member is inserted into the reflector lower sleeve portion and rotated so as to provide an interlocking connection therebetween.

5. The lamp and reflector assembly of claim 1, wherein said reflector member has a decorative petal shape and is molded from a clear plastic material.

6. The lamp and reflector assembly of claim 3, wherein said base socket member dual radial projections (24) each has a stop surface (26) provided at a terminal end of each said radial projection.

7. The lamp and reflector assembly of claim 4, wherein said base socket member dual radial projections each has a thickness "t" and said reflector member dual notches each has a width distance "w" which slightly exceeds the thickness of each said radial projection of the base socket member.

8. A decorative miniature electric lamp and reflector assembly, comprising:

(a) a bulb holder unit including an electric bulb having dual bare wires provided within an insert plug member, said insert plug member having a cylindrical shaped upper portion having an outer surface with multiple radial projections extending longitudinally along the outer surface, said insert plug member also having a lower portion having a lower end with the dual bare wires extending from the insert plug member lower end;

(b) a base socket member having a cylindrical-shaped upper portion and a lower portion, and having a cylindrical-shaped cavity in the base socket member upper portion, said cavity being complementary in shape so as to receive the insert plug member lower portion and provide a snug fit therebetween, said base socket member having an upper end and having dual oppositely-located radial projections each having a thickness "t" provided near the base socket member upper end; said base socket member having a lower end and having dual electrical insulated wires which are connected internally with said dual bare wires and extend from the base socket member lower end; and (c) a reflector member having a cylindrical-shaped lower sleeve portion, with the sleeve portion containing dual inner oppositely-located longitudinal extending grooves, with each said inner longitudinal groove having an upper end and having a stop surface and notch provided at each said longitudinal groove upper end, each said notch having a width "w" which slightly exceeds the thickness "t" of each said radial projection, so that the dual grooves and notches are each shaped and sized to receive one of the dual radial projections of said base socket member, whereby the base socket member upper end portion is inserted into the reflector member lower sleeve portion and then rotated so as to engage the base socket member dual radial projections snugly in the reflector member dual notches and thereby provide an interlocking connection joint between the base socket member and the reflector member.

* * * * *